United States Patent [19]

Geier

[11] 4,244,565

[45] Jan. 13, 1981

[54] METHOD OF CONTROLLING THE ENTRY OF MATERIAL INTO A SPIRAL COMPARTMENT STACKER

[75] Inventor: Josef Geier, Munich, Fed. Rep. of Germany

[73] Assignee: Gesellschaft fur Automation und Organisation GmbH, Munich, Fed. Rep. of Germany

[21] Appl. No.: 970,426

[22] Filed: Dec. 18, 1978

[30] Foreign Application Priority Data

Dec. 16, 1977 [DE] Fed. Rep. of Germany ..... 2756223

[51] Int. Cl.[3] ..... B65H 43/08; B65H 29/40

[52] U.S. Cl. ..... 271/176; 271/187; 271/315

[58] Field of Search ..... 271/187, 80, 176, 178, 271/199, 173, 64, 315, 295, 303, 279

[56] References Cited

U.S. PATENT DOCUMENTS

| | | | |
|---|---|---|---|
| 2,795,312 | 6/1957 | Howale | 271/64 X |
| 2,991,893 | 7/1961 | Kirsch et al. | 271/64 X |
| 3,391,777 | 7/1968 | Joa | 271/64 X |
| 3,502,321 | 3/1970 | McWhorter | 271/64 X |
| 3,748,937 | 7/1973 | Long | 271/64 UX |
| 4,046,371 | 9/1977 | Sevak | 271/178 |
| 4,088,314 | 5/1978 | Phillips | 271/187 X |

*Primary Examiner*—Bruce H. Stoner, Jr.

*Attorney, Agent, or Firm*—Schwartz, Jeffery, Schwaab, Mack, Blumenthal & Koch

[57] ABSTRACT

A method of controlling the entry of flat, flexible material into the compartments of the rapidly rotating spiral compartment stacker is provided whereby the synchronism of the material conveyed to the appropriate compartment in the stacker is checked and the introduction of the front edge of the material is corrected in the case of deviations from a given desired value dependent on said deviation. This method ensures that the material is introduced into the spiral compartment stacker without disruption and without its being damaged.

25 Claims, 9 Drawing Figures

Figure 1:
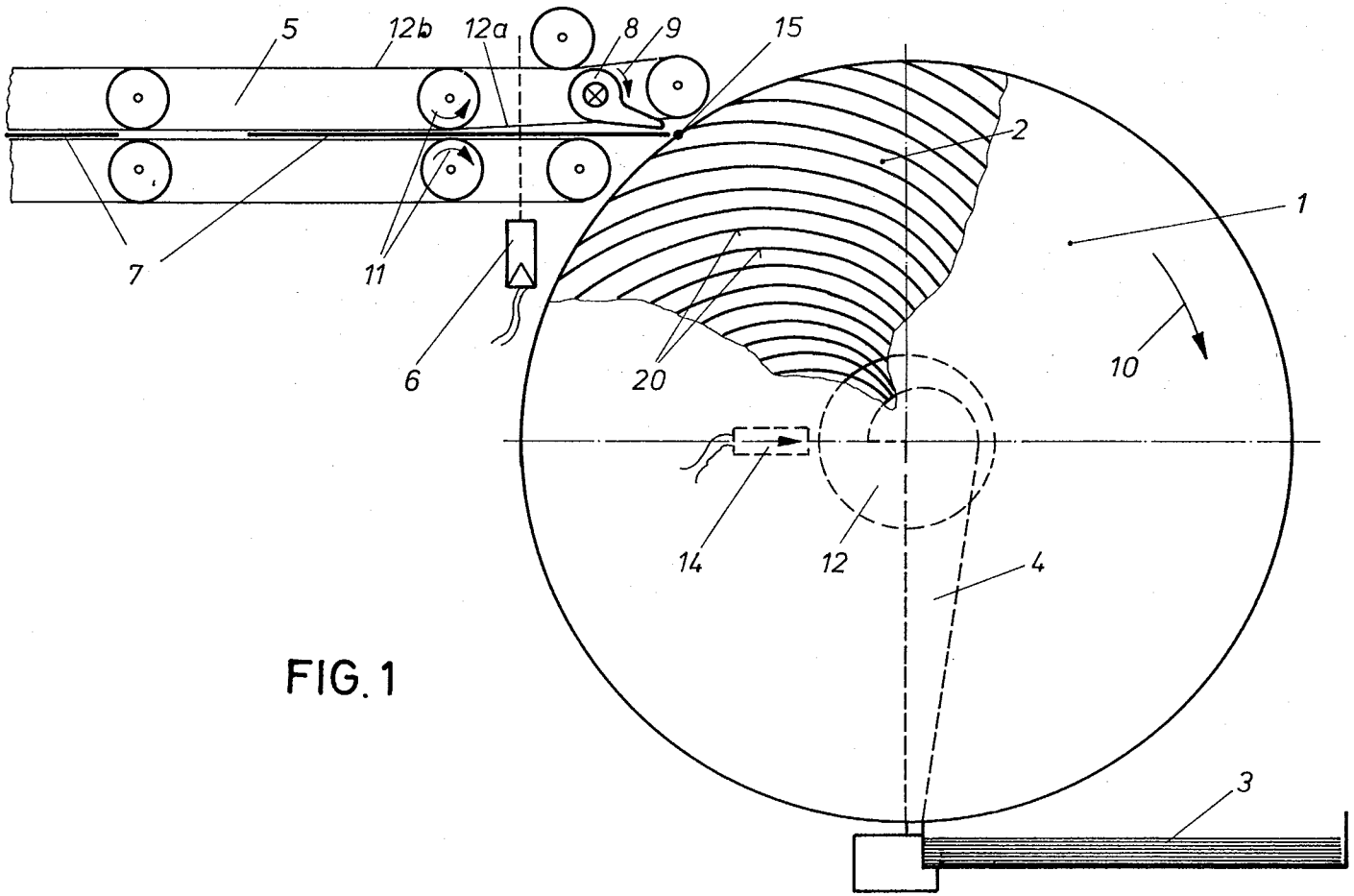

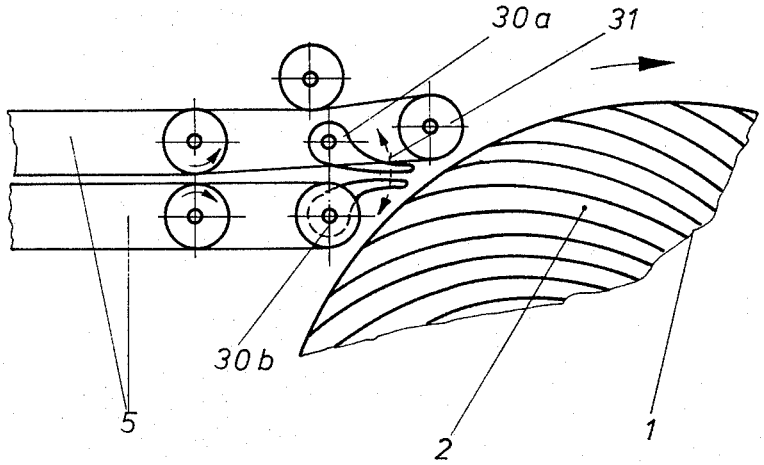
FIG. 6A
FIG. 6B
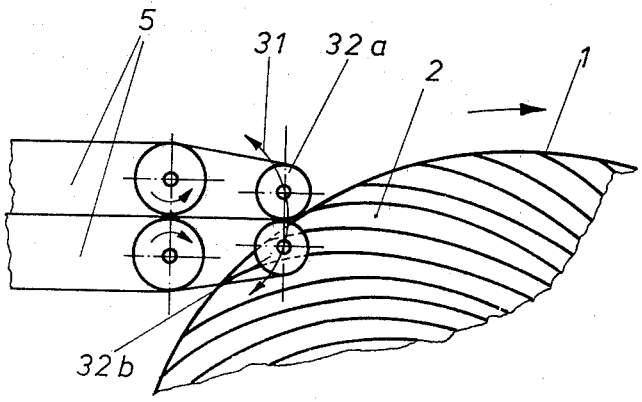

METHOD OF CONTROLLING THE ENTRY OF MATERIAL INTO A SPIRAL COMPARTMENT STACKER

The invention concerns a method of controlling the entry of flat, flexible material into the compartments of a rapidly rotating spiral compartment stacker.

The expression "flat, flexible material" refers in this case especially to all kinds of record means, bills, banknotes etc.

Spiral compartment stackers, which have the function of continuously slowing down bills conveyed forward at a high velocity by deflecting them into a spiral-shaped path before finally depositing them, are now known for a long time. As regards the mode of operation it is of great importance to ensure that the bill is introduced into a compartment of the stacker at the right moment or at the right position. Only in a certain ideal position, which the aperture of a compartment must assume in relation to the bill being conveyed towards it, is it possible to avoid the deformation or even destruction of the bill. In the case of conventional stackers the ideal position set—ideal point of introduction—can only be retained if on the one hand the bills are conveyed forward at constant velocity and constant timing distance (time distance measured from the front edge of one bill to the front edge of the next one) and if on the other hand the spiral compartment stacker is driven at constant velocity synchronous to the conveyance of the bills. However, since in practice uneven timing distances, variations in the velocity of the conveyance of the bills as well as the angular velocity of the stacker cannot always be avoided, it is necessary for various applications to take further steps to ensure that in the case of disruption the bills enter the stacker compartments without being deformed.

Thus by slowing down or speeding up the spiral compartment stacker it is, for example, possible to synchronise it with every approaching bill. A disadvantage of this solution is the fact that due to the positive or negative acceleration acting upon the spiral compartment stacker the latter is exposed to strong moments of inertia which in the case of limited technical input do not permit very high angular velocities of the stacker drum.

Correspondingly, it is the object of the invention to provide a method of controlling the introduction of flat, flexible material into the compartments of a spiral compartment stacker in the case of which the above-named disadvantages are avoided and which ensures that the material is introduced without disruption and without its being damaged.

The invention is based on the knowledge that this object can be solved by directing the introduction of the front edge of the material into the spiral compartment stacker.

The subject matter of the invention is a method of controlling flat, flexible material into the compartments of a rapidly rotating spiral compartment stacker characterised by the fact that the synchronism of the material being conveyed with the appropriate compartment of the stacker is checked and that in the case of deviations from a given desired value the introduction of the front edge of the material is corrected dependent on the deviation, i.e. in proportion to the deviation.

The invention will be explained hereinafter in more detail with the aid of an embodiment example and with reference to the drawing.

Figure 2:
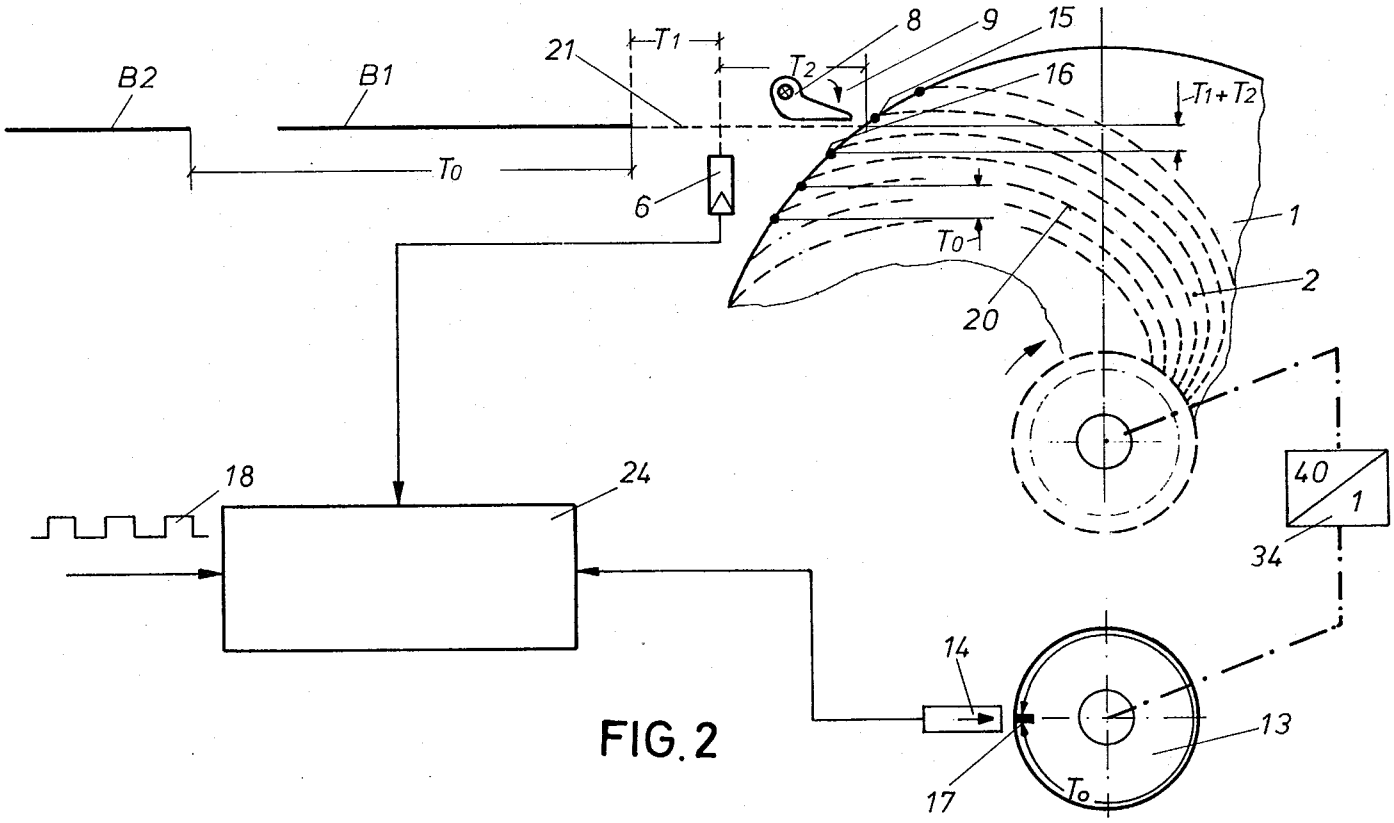
Figure 3:
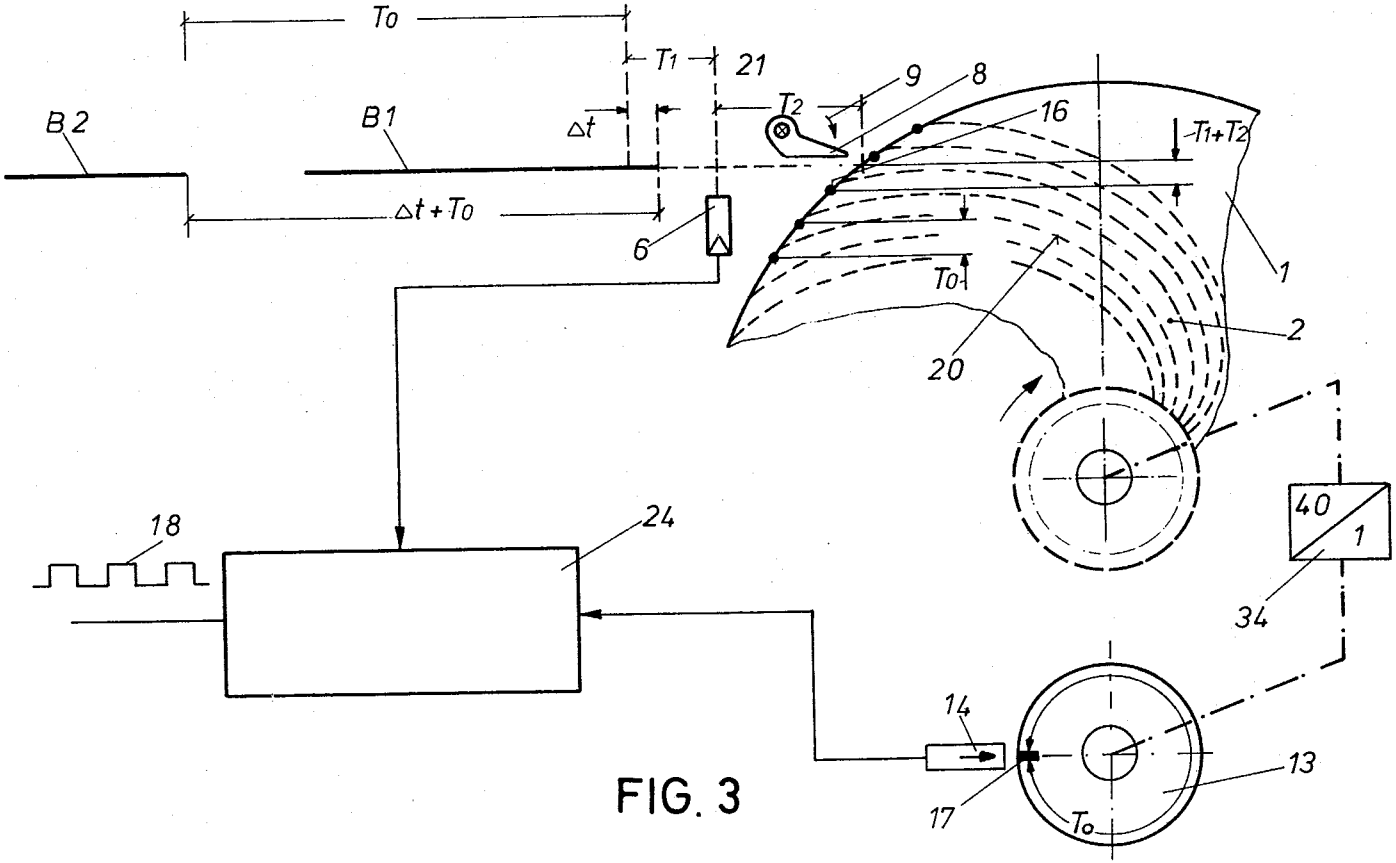
Figure 4:
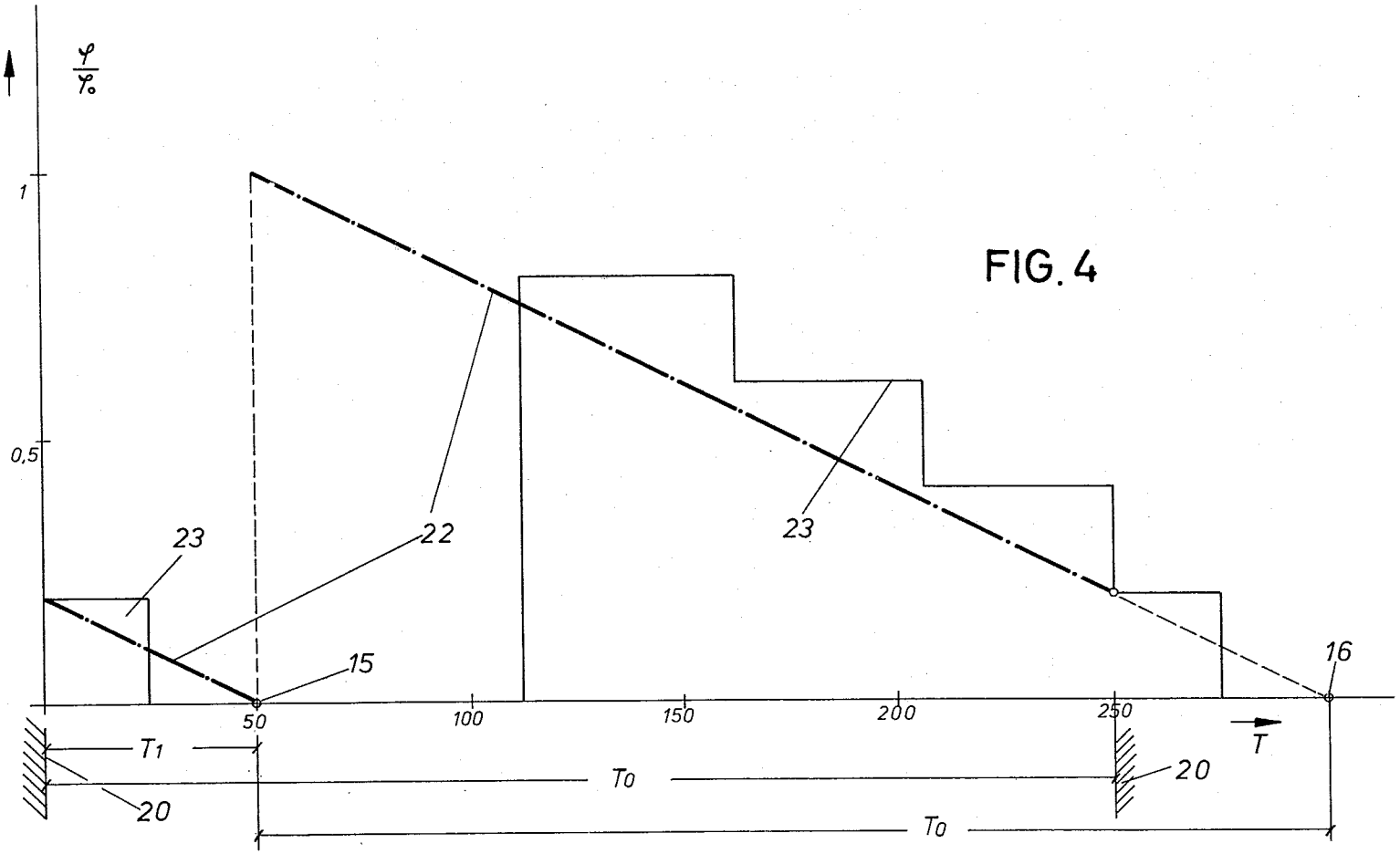
Figure 5:
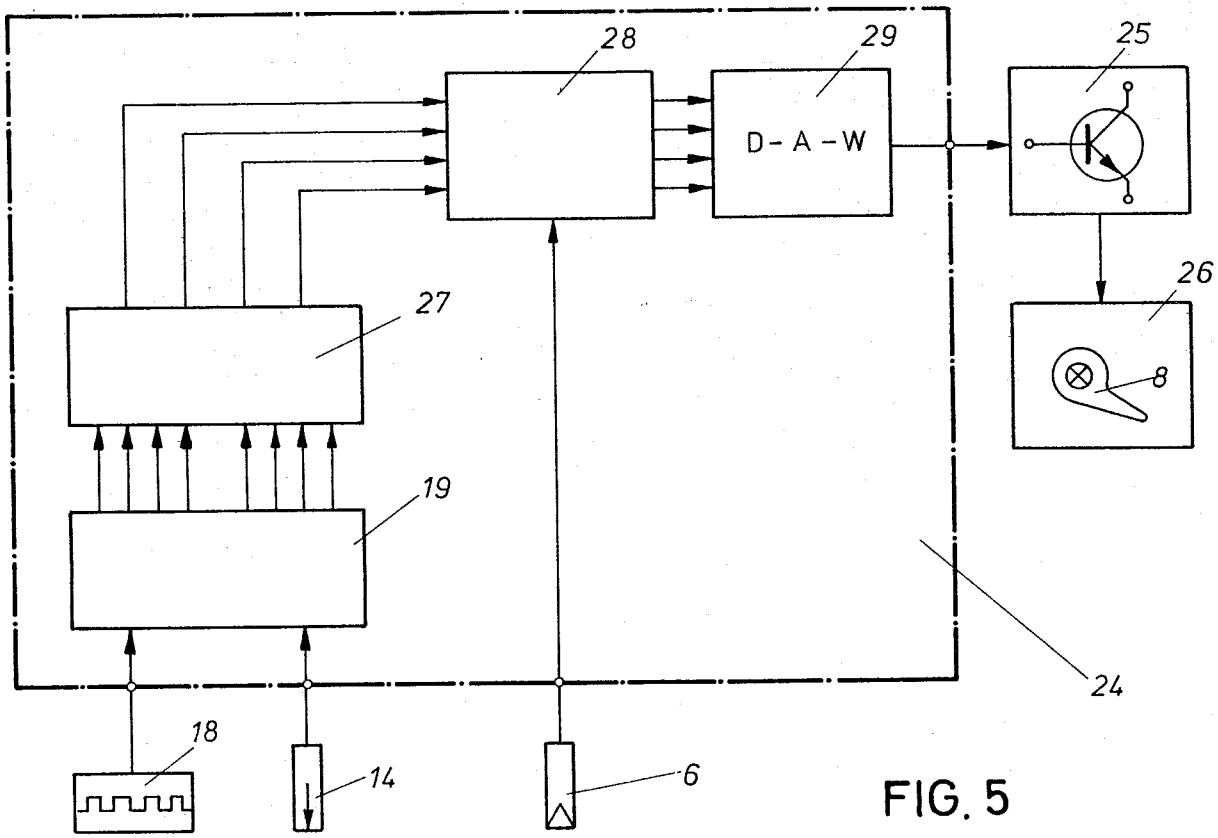

FIG. 1 shows a general view of the spiral compartment stacker with the means for controlling the introduction of the material, FIG. 2 shows a schematic view of synchronous introduction, FIG. 3 shows a schematic view of asynchronous introduction, FIG. 4 is a drawing to illustrate the angular deviation of a regulating finger dependent on a manipulated variable T, FIG. 5 shows a detailed circuit diagram of the control unit FIGS. *6a, 6b* show schematic views of the controlling of the material introduction with parallel construction and FIGS. *7a, 7b* show schematic views of the pneumatic controlling of the material introduction.

A spiral compartment stacker is described in the German patent specification (Offenlegungsschrift) No. 25 55 307. Explicit reference is hereby made to this disclosure.

In accordance with the general view of the device shown in FIG. 1, the stacker drum 1 rotating in the direction of the arrow 10 exhibits compartments 2 distributed evenly along its circumference whose partitions 20 are curved helically towards the centre of the drum. The bills 7 pass one after the other along a conveying system 5, which is driven in the direction of the arrows 11, into the compartments 2 of the stacker drum 1, which passes by the conveying system 5, in such a manner that they are continuously slowed down as they move along the curved partitions 20. As will be apparent from the drawing, the partitions 20 are spaced further from each other in the region of the drum circumference than in the region of the drum axis so that the cross section of each compartment, taken in a direction normal to the drum axis, is larger near the drum circumference than near the drum axis and so that the same cross section has a helically inward tapering configuration.

Pulled out of the compartments by means of a stripper 4, the bills 7 fall onto the stack 3. The optimum drum and hence the optimum compartment position in relation to a bill 7, which has been conveyed forward and is just about to be introduced, is shown in FIG. 1. As can be seen in the drawing, the bill 7 reaches the compartment aperture 2 in the upper third portion at an ideal point of entry, which is characterised by the position 15, so that introduced tangentially it is slowed down along the corresponding upper partition wall 20 of the compartment 2.

As mentioned at the beginning, disruptions may occur in practice if, for example, the timing distance of the bills in relation to one another changes. In order to nevertheless ensure that in this case a bill reaches a compartment at the ideal point of entry, a pivotally mounted regulating finger 8 is provided which, as shown in FIG. 1, is arranged between the belts 12*a* and 12*b* of the conveying system 5 immediately in front of the stacker drum. In case of disruption (asynchronism), the front edge of a bill conveyed either too early or too late in relation to the stacker drum is influenced by means of the regulating finger 8 due to a more or less strong depression in the direction of the arrow 9 with the result that fundementally the bill will always arrive at a compartment at the ideal point of entry 15. In order to determine the synchronism or asynchronism of oncoming bills, the local position of the front edge of a bill is determined in relation to the position of an ideal point of entry 15 into the stacker drum 1 at given intervals via a time measurement. In other words, immediately before each bill enters the stacker drum a time measurement determines whether its front edge will meet the ideal point of entry 15 into a stacker compartment 2. The basis of the time measurement is a system timing (cf. hereinafter; FIG. 2, timing signal 18) the impulse duration of which corresponds to a definite distance of the conveying system and stacker drum. Thus, the time measurement is rendered independent of the velocity of the system.

If the time measurement indicates a definite desired value, it is ensured that the bill is being conveyed synchronous to the stacker drum. In this case, as shown in FIG. 1, the regulating finger 8 does not move. In the case of deviations from the desired value, the finger 8 is controlled accordingly via an electronic controlling device as will be explained hereinafter.

The deviations from the synchronous run of the bills in relation to the stacker drum are determined by means of two pick-ups, namely an approximation scanner 14 and a light barrier 6 (cf. also FIG. 2).

The approximation scanner 14 scans a contact disc 13 on which a contact lug 17 is fixed. The contact disc 13 (cf. FIG. 2) is coupled with the stacker drum 1 via a gear unit 34. In the embodiment example shown in the figures the gear unit 34 has a gear ratio of 40:1 in keeping with the number of compartments 2 of the stacker drum—the latter has 40 compartments. This means that the contact disc 13 carries out a complete revolution while the stacker drum 1 further rotates through a distance corresponding to the width of the opening of a compartment 2 only. In this case, the length of time the contact lug 17 requires for a complete revolution (cf. FIG. 2) corresponds to the time distance—timing distance $T_0$—of the front edges of two bills. Due to the ratio between the contact disc 13 and the stacker drum 1, two consecutive points of introduction 15, 16 and also the partition 20, each situated at an even distance above the points of insertion, have the time distance $T_0$ as well.

The light barrier 6, arranged in front of the stacker drum 1, registers the front edge of each bill. The resulting signal is used to initiate any necessary controlling of the regulating finger.

FIG. 2 shows the synchronous introduction of a bill into a compartment 2 of the stacker 1 in an instantaneous situation. The situation has been selected in such a manner that the approximation scanner 14 is just registering a contact lug 17 of the contact disc 13. In the case of synchronism, the stacker drum is adjusted in relation to the oncoming bill in such a manner that at the moment of registration of a contact lug by means of the approximation scanner the front edge of the bill to be stacked (in FIG. 2 the bill $B_1$) has the time distance $T_1+T_2$ from the stacker drum. At the same time, the point of introduction 16 in question has the same time distance $T_1+T_2$ from a so-called line of introduction 21 (an imaginary line along which the bills are conveyed to the stacker) indicated in FIG. 2 by means of a dash-line.

It follows from the uniformity of the time distances that the front edge of the bill will arrive exactly at the ideal point of introduction 16 of the compartment in question after the period of time $T_1+T_2$.

In this case $T_1$ is the period of time which elapses from the moment the contact lug is registered to the moment when the front edge of the bill reaches the light barrier. It is per definitionem the desired time which is determined in a control unit 24 in the case of each bill when the latter moves synchronously towards the stacker. Deviations from the period of time $T_1$ according to the relationship $T_1 \pm \Delta t$ indicate an asynchronous bill, i.e. a bill which is being conveyed either too quickly or too slowly in relation to the stacker.

The desired time $T_1$ is selected in such a manner that the effective time ($T_1 \pm \Delta t > 0$), which results from the bills which are being conveyed asynchronously, is always greater than 0. In other words, it is ensured that the light barrier signal always comes after the signal from the approximation scanner. This results in the fact that bills arriving either too early or too late have control values with the same plus or minus sign. The electronic evaluation becomes more complex if synchronism is defined in such a manner that it is attained when the light barrier signal and the signal from the approximation scanner come at the same time. In this case, control values result whose plus or minus signs vary depending on which of the two signals appears first.

The time $T_2$ is the time which the front edge of the bill requires in order to reach the appropriate point of entry after the signal is given by the first pick-up (light barrier). This period of time $T_2$ is selected in such a manner that it is longer than the time required for the maximum deflection of the front edge of the bill or for the maximum deflection of the regulating finger 8. $T_2$ may be shortened if the control rate of the regulating finger is high.

Hereinafter, the determination of the desired time $T_1$ will be described in the case of synchronism.

FIG. 2 shows the time at which the contact lug 17 is registered by the approximation scanner 14. Thereafter, the signal from the approximation scanner 14 sets a counter in motion which is integrated in the control unit 24 and which receiving its impulses from a timing signal 18 begins to count upwards starting from the counter position "0". If, thereafter, the front edge of the bill reaches the light barrier 6, a conclusion may be drawn as to the position of the bill in question in relation to the stacker drum independent of the counter position reached. In the case of the situation shown in FIG. 2, the period of time determined (counter position) amounts to $T_1$ and this corresponds to a fixed number of timing units of the timing signal 18. As will be explained in greater detail hereinafter, the reading of the desired time $T_1$ is evaluated in such a manner that the regulating finger remains stationary since it has been ensured that after a further period of time $T_2$ the front edge of the bill will arrive exactly at the ideal point of entry 16.

The measuring process for determining the desired time $T_1$ repeats itself after each revolution of the contact disc 13, i.e. after the period $T_0$. If synchronism is still in existence, the front edge of the following bill $B_2$ is again so far away from the light barrier after the period $T_0$ that the time measurement shows the desired time $T_1$. If, however, asynchronism between the motion of the bills and the motion of the stacker exists on the grounds of some disruption or other, the time from which the signal from the approximation scanner is given off to the moment when the signal from the light barrier comes no longer amounts to $T_1$ but to $T_1 \pm \Delta t$, in which case $\pm \Delta t$ indicates the positive or negative deviation from the desired time $T_1$.

One possible disruption is illustrated by way of example in FIG. 3. As can be seen in the drawing, the timing distance between the bills is no longer $T_0$ but $T_0+\Delta t$. If the signal comes from the approximation scanner 14, the front edge of the bill $B_1$ in this case no longer requires the desired time $T_1$ until the signal from the light barrier 6 appears, but the period of time $T_1-\Delta t$. Thus, the front edge of the bill, which appears too early reaches the appropriate stacker compartment 2 in front of the ideal point of entry 16 since the ideal point of entry 16 does not reach the line of introduction 21 until after the period $T_1+T_2$. In order to ensure that the front edge of the bill nevertheless still reaches the ideal point of entry 16, the bill is depressed by means of the rotary motion of the regulating finger 8 in the direction of the arrow 9, whereby the angle of rotation depends on the size of the deviation $\Delta t$ from the desired time $T_1$. The size of the deviation is determined via the counter position of the counter situated in the control unit 24 which is attained at the moment the signal comes from the light barrier.

Analogously, the same is true of a bill which arrives too late in the case of which the timing distance to the next document has decreased by $\Delta t$ to $T_0-\Delta t$ due for example to slippage in the conveying system. In the latter case in which the counter determines a period of $T_1+\Delta t$, the front edge of the bill is depressed so far that it is not brought to the point of entry 16 of the originally appropriate compartment but to the point of entry of the following compartment since the originally appropriate point of entry 16 has already passed the line of introduction 21 after the period $T_1+T_2$. By means of the manner of controlling the entry of the bills described heretofore, it can be achieved that in case of necessity the regulating finger is always deflected in only one direction (arrow 9). Also, as described heretofore, deviations in the angular velocity of the stacker and deviations in the velocity of the bill conveying system are determined and corrected accordingly. All situations can be traced back to a deviation $\Delta t$ from the desired time $T_1$. It will be apparent from the foregoing that the deflection of the front edges of the bills by the deflecting fingers is in proportion to any asynchronization which has been determined, to thus substantially correct any deviation in the entry of material into a compartment from the ideal point of entry.

The dependence of the rotary motion of the regulating finger 8 on the time measurement, determined by means of the counter, will now be explained with reference to FIG. 4 before the construction of the control unit for controlling the regulating finger 8 is described in more detail.

The unit of time measurement—plotted on the abscissa of the coordinate system—is the timing unit T. This results from the timing signal 18 which, as shown in FIG. 3, is guided to the control unit 24. All time measurements $T_1$, $T_0$ etc., mentioned heretofore, are multiples of this timing unit T. Thus, the desired time $T_1$ (cf. FIG. 4) comprises 50 timing units while the timing distance $T_0$ between the front edges of two bills or the distance between two partitions 20 of a compartment or the distance between two ideal points of entry 15, 16 amounts to 250 timing units. The angles of rotation $\phi$, which are possible, are plotted on the ordinate of the coordinate system (normalised representation).

The line 22, indicated by a dot-dash line, which results from the analogous evaluation of the counter position, will now first of all be discussed with reference to the drawing. At $T=50$ timing units, this line exhibits a point of discontinuity which coincides with the ideal point of entry of a compartment. In this point the regulating finger remains motionless. It is now fundamentally true that the regulating finger, as already mentioned, is always turned in one direction only. If the number of timing units T, added up by the counter, are in the range $0 \leqq T < 50$, the front edge of the bill arrives in front of the ideal point of entry 15 too early and must be depressed to a greater or lesser extent by means of the regulating finger dependent on the timing number in accordance with the first part of the line 22 in order to nevertheless reach the ideal point of entry 15.

If the determined number of timing units lies in the range of $50 < T \leqq 250$, the front edge of the bill reaches the ideal point of entry 15 too late and is depressed in accordance with the second part of the line 22 dependent on the determined timing number to such an extent that it always reaches the ideal point of entry 16 of the following compartment. In this case the compartment originally appropriate for the bill remains empty.

The regulating finger is therefore always activated if the number added up by the counter amounts to more or less than 50 timing units. However, it is in practice not necessary to compensate every deviation from the desired value by a rotation of the regulating finger. A readjustment need, for example, not take place in the vicinity of the ideal point of entry 15 since the stacker drum can apply its slowing down effect on oncoming bills if they arrive at the upper third portion of a compartment in the vicinity of the ideal point of entry 15. Furthermore, it is sufficient if the deflection of the regulating finger is kept constant for certain timing number ranges.

From the considerations detailed above, it follows that the regulating finger need only be activated in discrete ranges. The interrelation between the angular deviation of the regulating finger and the deviation of the desired time resulting therefrom is illustrated in FIG. 4 by means of the step function 23.

Then the readjustment of the regulating finger in accordance with five various values (angular positions) and depending on the size of the deviation of the desired time is carried out, whereby the 0 position is enclosed in the vicinity of the ideal point of entry 15.

The realisation of a step function, as illustrated in FIG. 4, will be explained hereinafter with reference to the schematic construction of the control unit.

In accordance with the circuit diagram shown in FIG. 5, the signal from the approximation scanner 14 (FIG. 2), the signal from the light barrier 6 and the timing signal 18 lead to the control unit 24.

When the signal from the approximation scanner 14 appears the counter 19 for the timing signal 18 is released and begins to count starting with 0. The exits of the counter 19 are connected to a decoder 27. The latter is programmed in such a manner that it produces five various digital values (including the value "0") dependent on defined counter position ranges (cf the five stage step function in FIG. 4). The discretely varying digital values continuously arrive at an intermediate memory 28. This always transmits its information to a digital-analog transducer 29 when the signal from the light barrier appears, i.e. when the light barrier registers the front edge of the bill. The analog signal determined, which according to the counter position reached, is a measure for the deviation of the desired value, finally arrives via a driver 25 at a stepping motor 26 through which the regulating finger 8 is accordingly deflected dependent on the magnitude of the analog signal. The stepping motor is not driven in a digital manner, as is usual, but in an analog manner.

In this case, two of the three contacts of the stepping motor, which is connected in a delta connection, are placed on fixed potentials while the third contact varies between the fixed potentials dependent on the activation of the driver stage. The advantage of the analog activation of the stepping motor lies in the fact that the technical input for switching purposes are reduced considerably.

As mentioned above, the shape of the step function (height and width of the steps) depends on the programming of the decoder 27. Thus it is possible to select a step function which is ideally adapted to the given circumstances by simply reprogramming or by using variously programmed decoder modules.

Up to now it has been assumed that the regulating finger is deflected in only one direction. It is, however, also possible to carry out the regulation in two directions running opposite to each other. This may be accomplished for instance with the aid of a parallel construction as illustrated schematically in FIG. 6*a* and 6*b*. The two regulating fingers 30*a*, 30*b* in FIG. 6*a* are coupled with each other and may be rotated mutually in the directions indicated by the double arrow 31.

This solution has the advantage that the deflection distances are shortened by virtue of which the regulating velocity can be increased. On the other hand, however, more mechanical input it necessary for accomplishing the latter solution.

FIG. 6*b* shows a further possibility for parallel construction in the case of which the end rollers 32*a*, 32*b* of the conveying system 5, which can be rotated in the directions indicated by the double arrow 31, assume the function of the coupled regulating fingers 30*a*, 30*b* in FIG. 6*a*.

Figure 7A:
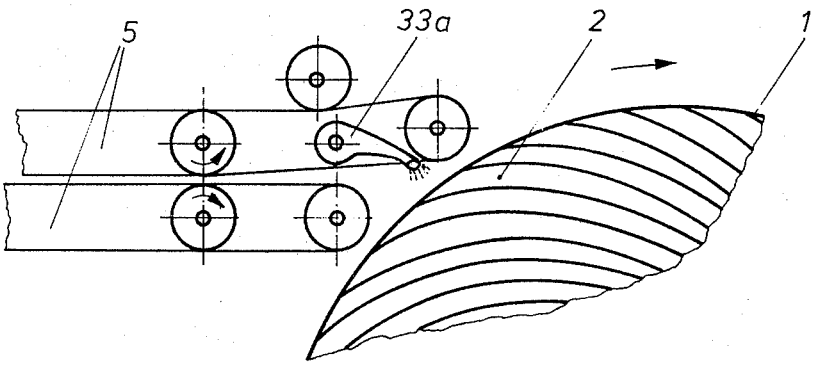
Figure 7B:
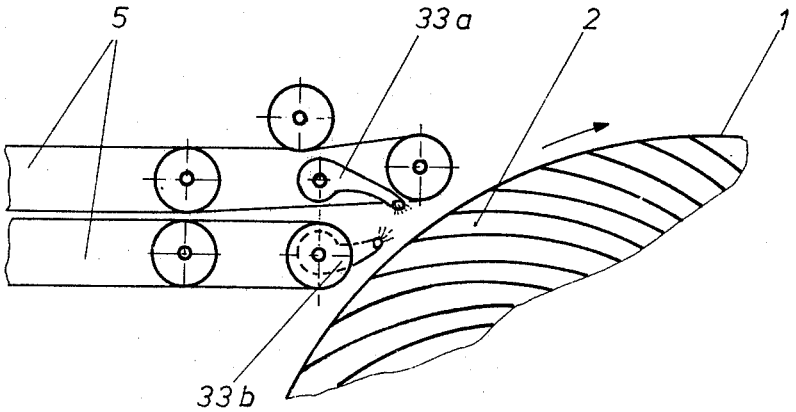

The deflection may also be carried out pneumatically by replacing the regulating fingers or end rollers by the air blast nozzles 33*a*, 33*b* illustrated in FIGS. 7*a* and 7*b*. In this case, the deflection width can be controlled by varying the pulse length of the blast from the nozzles.

What is claimed is:

1. A method of controlling the entry of flat, flexible sheet material into compartments of a rapidly rotating spiral compartment stacker, the spiral compartment stacker having a rotating stacker drum with helically curved partitions defining spiral compartments in said drum, each sheet spiral compartments, each compartment having an ideal point of entry for the sheet material, the method comprising the steps of:

conveying the sheet material to the rotating drum;

checking the synchronization between the conveyance of the sheet, on the one hand, and the position of the ideal point of entry of the material into a spiral compartment, on the other hand;

deflecting the front edge of the material in proportion to any asynchronization found in said checking step to substantially correct any deviation in the entry of material into a compartment from the ideal point of entry;

stripping said sheet material from said stacker drum; and stacking said stripped sheet material in a stack.

2. The method of claim 1 wherein the correction of the point of entry is carried out by means of a mechanical deflection of the front edge of the material.

3. The method of claim 2 wherein the mechanical deflection of the front edge of the material is carried out by rotating a regulating finger pivotally mounted above the line of introduction and immediately in front of the spiral compartment stacker.

4. The method of claim 3 wherein the regulating finger is rotated in one direction.

5. The method of claim 3 wherein a first pick-up is provided which is arranged on the line of conveyance of the material and which produces a signal when it registers the front edge of each unit of material.

6. The method of claim 5 wherein a second pick-up is provided which is arranged on the stacker drum and which produces a signal when each point of entry of a compartment assumes a defined position in relation to the conveying system.

7. The method of claim 6 wherein the relative position of the front edge of the material as regards the point of entry of the corresponding compartment is determined dependent on the time when the signals from the pick-ups appear.

8. The method of claim 7 wherein the two pick-ups are positioned in such a manner that in the case of synchronism the signal from the second pick-up appears when the front edge of the material is situated a defined length of time, which comprises a lead time ($T_1$) and a time lag ($T_2$), from the corresponding point of entry.

9. The method of claim 8 wherein the lead time ($T_1$) in the case of synchronism is the time which the front edge of the material requires in order to reach the first pick-up after the signal from the second pick-up appears.

10. The method of claim 9 wherein the lead time ($T_1$) is larger than the largest time deviation possible on the grounds of asynchronism ($T_1 \pm \Delta t > 0$).

11. The method of claim 10 wherein the time lag ($T_2$) is the time which the front edge of the material requires in order to arrive at the appropriate point of entry after the signal from the first pick-up appears.

12. The method of claim 11 wherein the time lag ($T_2$) is larger than the time which is necessary for the maximum deflection of the front edge of the material.

13. The method of claim 12 wherein a control value, which is evaluated in accordance with a linear function, is determined dependent on the deviation from the lead time ($T_1$).

14. The method of claim 12 wherein a control value is evaluated discretely in accordance with a step function.

15. The method of claim 14 wherein the regulating finger is deflected with the aid of a stepping motor which is analogously controlled via a driver.

16. The method of claim 2 wherein the correction of the point of entry of the front edge of the material is carried out by means of two regulating fingers coupled with each other and facing each other.

17. The method of claim 16 wherein the coupled regulating fingers are rotated in two opposite directions.

18. The method of claim 2 wherein the correction of the point of entry is carried out by means of a pair of conveyor end rollers arranged immediately in front of the spiral compartment stacker and swingable in two directions.

19. The method of claim 1 wherein the correction of the point of entry is carried out by a pneumatic deflection of the front edge of the material.

20. The method of claim 19 wherein the pneumatic correction of the front edge of the material is carried out in one direction by means of a blast nozzle fixed above the line of introduction immediately in front of the spiral compartment stacker.

21. The method of claim 19 wherein the deflection of the front edge of the material is carried out in two opposite directions by means of two blast nozzles arranged opposite each other.

22. The method of claim 20 or 21 wherein the deflection width is controlled by means of the pulse length of the air blast from the nozzle.

23. A spiral compartment stacking apparatus comprising:

a stacker drum rotatably mounted on a frame member;

a means for rotating said stacker drum;

a plurality of helically disposed partitions in said drum, said partitions defining a plurality of compartments in said drum for receiving flat, flexible sheet material therein, each sheet having a front edge for entry into one of the spiral compartments, said compartments having entrance openings at the circumference of the drum, said compartments extending toward the drum axis in a helical arrangement, said partitions being spaced further from each other in the region of the drum circumference than in the region of the drum axis, so that the cross section of each compartment, taken in a direction normal to the drum axis, is larger near the drum circumference than near the drum axis and so that the same cross section has a helically inwardly tapering configuration, each entrance opening of each compartment having an ideal point of entry for the sheet material;

a conveying means for conveying flat, flexible sheet material toward said stacker drum during rotation of said drum;

a stripper means for stripping the flat, flexible sheet material from said stacker drum;

a stacking area at the exit point of said stacker drum;

means for checking to determine whether the conveyance of the sheet material toward the stacker drum is synchronized with the position of the ideal point of entry of the sheet material into a spiral compartment of the rotating drum; and means for deflecting the front edge of the sheet material in proportion to any asynchronization found in said checking step to thus substantially correct any deviation in the entry of material into a compartment from the ideal point of entry.

24. The apparatus of claim 23 wherein the checking means comprises:

a control unit;

a scanner for scanning a contact lug fixedly positioned on a contact disk and signaling each revolution of said contact lug to said control unit said contact disk being coupled for rotation corresponding to the rotation of said stacker drum;

a light barrier arranged on the conveying means for registering the leading edge of each unit of flat, flexible material and signaling each registration to said control unit;

wherein said control unit generates a control signal for actuating said deflecting means.

25. The apparatus of claim 23 wherein the deflecting means comprises a regulating finger arranged on the conveying means at the point of entry of said stacker compartments; a driver motor for converting the control signals from said control unit and transmitting a signal to a stepping motor controling the movement of said regulating finger.

* * * * *